United States Patent [19]

August

[11] Patent Number: 4,964,379

[45] Date of Patent: Oct. 23, 1990

[54] TWIN-PISTON TWO-STROKE ENGINE

[76] Inventor: Paul August, C/Ballester 43, Barcelona, Spain

[21] Appl. No.: 348,248

[22] Filed: May 5, 1989

[30] Foreign Application Priority Data

Jun. 7, 1988 [DE] Fed. Rep. of Germany ..... 3819196

[51] Int. Cl.[5] ..... F02B 25/08

[52] U.S. Cl. ..... 123/51 B; 123/57 B; 123/307; 123/661; 123/37; 123/309

[58] Field of Search ..... 123/58 R, 53 R, 53 B, 123/307, 661, 667, 257, 260, 262, 269, 37, 57 B, 309, 51 R, 51 A, 51 B

[56] References Cited

U.S. PATENT DOCUMENTS

| | | | |
|---|---|---|---|
| 1,540,459 | 6/1925 | Burtnett | 123/53 B |
| 1,645,797 | 10/1927 | Burtnett | 123/53 B |
| 1,660,860 | 2/1928 | Burtnett | 123/53 B |
| 1,794,829 | 3/1931 | Burtnett | 123/53 B |
| 2,014,771 | 9/1935 | Mallory | 123/53 B |
| 2,184,603 | 12/1939 | Portmann | 123/53 B |
| 2,196,252 | 4/1940 | Daub | 123/53 B |
| 4,779,581 | 10/1988 | Maier | 123/73 B |

FOREIGN PATENT DOCUMENTS

| | | | |
|---|---|---|---|
| 549013 | 6/1929 | Fed. Rep. of Germany | 123/53 B |
| 711136 | 8/1941 | Fed. Rep. of Germany | 123/53 R |
| 921061 | 10/1954 | Fed. Rep. of Germany | 123/53 B |
| 399911 | 10/1933 | United Kingdom | 123/53 B |

*Primary Examiner*—David A. Okonsky

*Attorney, Agent, or Firm*—Nilsson, Robbins, Dalgarn, Berlinger, Carson & Wurst

[57] ABSTRACT

Two pistons in adjacently situated cylinders in a twin-piston two-stroke engine share a common combustion chamber. To ensure low exhaust gas emissions with low consumption, a lean mixture is burnt whereof the complete combustion is made possible by designing the combustion chamber so that circulation of the ignited mixture takes place and the mixture burns through rapidly. The twin-piston two-stroke engine may also be devised to run with a stratified charge, the centrally arranged partition in the twin cylinder providing excellent separation between the lean and rich mixture portions.

20 Claims, 1 Drawing Sheet

TWIN-PISTON TWO-STROKE ENGINE

BACKGROUND OF THE INVENTION

The invention is concerned with a twin-piston two-stroke engine in which a piston runs in each of two adjacently situated cylinders, the two pistons forming a common combustion chamber at top-dead-center with the cylinder head as disclosed in the Puch system for example.

SUMMARY OF THE INVENTION

It is an object of the present invention to develop a twin-piston engine of the above type having lowered consumption and reduced exhaust gas emission levels.

For this purpose, the engine is designed so that circulation of the fuel-air mixture, or rather of the ignited mixture, occurs in the common combustion chamber, with the advantage that even lean mixtures burn through rapidly thereby obtaining a low consumption with very low exhaust gas emission figures.

The nitrous oxides are reduced so considerably that they comply with regulations with a mixture composition having a lambda factor of 1.3 and higher. So that a lean mixture may be burnt through perfectly and rapidly enough, vigorous circulation is needed in the combustion chamber. It is only in this case that the combustion occurs as rapidly as with lambda 0.9 to 1.0 mixtures. This is required to secure a very low consumption with a satisfactory performance.

The inventor has already gained experience with 4-stroke engines comprising analogously formed combustion chambers. With these, the consumption was lowered by approximately 20% and amounts to below 260 grams/KWh beyond 120 k.p.h. Under full load, it amounts to 240–245 grams/KWh between 2,000 and 5,000 liters/minute. The FTP 75 (CVS) test on a FIAT Ritmo 75 yielded the following values with this combustion chamber and a minicatalyser: CH: 0.32 - CO: 2.8 - $NO_x$: 0.71 grams/mile consumption: 6.3 liter/100 km=37.1 m.p.g.

The consumption is also very low in this case, being lower by 32% in the composite test than the U.S.A. specification.

The exhaust levels lie some 20–30% lower than the USA specification, and lower by 30 to 70% than the EEC ordinances.

In a preferred embodiment of the present invention, the twin-piston engine is constructed as a Puch system two-stroke engine. In its series-production version, the Puch system twin-piston two-stroke engine does not have a higher consumption than a 4-stroke engine, since it has no fresh-mixture losses during charging, and different control periods for the inlet and exhaust, so that the same values as with a 4-stroke engine should be obtainable with an engine of this kind.

The 2-stroke engine has the following advantages however:

1. smooth running of the engine is obtained with three cylinders instead of with six cylinders in the case of a 4-stroke engine.
2. The specific engine output is higher.
3. The valveless cylinder head has a smaller structural height, has a very uncomplicated form and may be produced economically.

To summarise, the following advantages result: For the same performance, the engine becomes approximately 30% smaller, lighter and better value than a corresponding four-cylinder 4-stroke engine, and has the smooth running of a 4-stroke six-cylinder engine.

In a preferred embodiment of the invention, a powerful circulation of the fuel-air mixture or rather of the ignited mixture is generated in the common combustion chamber by the fact that a long squish gap is formed between the top surface of one piston and the cylinder head and that the cylinder head has the approximate shape of an arc beyond this squish gap.

The piston controlling the induction port consequently is provided at its side situated close to the induction port with an initial straight oblique portion directed against the cylinder head, which terminates in a top piston edge extending throughout the width of the piston and lying horizontally (with the cylinders placed upright).

This comb-like top piston edge is followed by a concave flute or the like in the piston crown which at the t.d.c. position of both pistons forms a continuous surface with the adjacent piston crown of the piston which controls the exhaust port.

This surface of the piston controlling the exhaust port is preferably also formed as a straight section and is situated in the area of a recess which again leads into a concave flute or the like which for its part merges into a straight section, this straight section forming part of another squish gap.

At the t.d.c. position, the piston controlling the induction port consequently forms a long primary squish gap which results in a rapid expulsion of the mixture trapped in this region in the direction of the combustion chamber. A strong circulatory flow is consequently generated in the combustion chamber as a result of the oval shape of the top cylinder wall, which encounters intermerging radii of rounded-off form on all portions in contact with the mixture, so that the rotation does not encounter any substantial flow resistance.

This rapidly circulating flow is further enhanced by means of a straight shorter squish gap which similarly expels a flow of gas in the direction of this circulation and thereby further accelerates it.

A further increase in the circulation results if the ignition jet of the spark plug flows out of an outflow passage and this passage also extends in the direction of the circulation.

Provision is made in a second embodiment of the present invention that a spark plug extends from the cylinder head into a recess in the piston which controls the induction port. The part of the cylinder head from which the plug projects is again formed as a straight section which is directed upwards obliquely and continues the top cylinder wall without interruption. This recess in the piston crown initially acts as a squish gap in combination with the obliquely directed straight section. Furthermore, the ignition jet generated by the spark plug causes an additional acceleration of the ignited mixture leaving this precombustion space, so that a powerful circulation is again engendered thereby.

Provision is made in another embodiment of the present invention for a stratified charge of the inflowing combustion air to be established, which is achieved in a particularly simple and advantageous manner by virtue of the engine construction according to the invention. The combustion chamber of the invention with its virorous circulation of the mixture allows a stratified charge to be obtained which ensures satisfactory intermixing with the lean mixture after ignition.

Intermixing of the stratified charge is consequently avoided before ignition, the richer mixture then being ignited first, whereupon the lean mixture is mixed with the ignited richer mixture.

In the embodiments of the invention which do not provide for a stratified charge, a second spark plug may be of great importance for rapid combustion, whereas the second spark plug may be omitted in the embodiment making use of a stratified charge.

The invention is described in particular in the following drawings illustrating several embodiments. Other features essential to the invention and advantages of the invention will become apparent from the drawings and their description.

DETAILED DESCRIPTION

Figure 1:
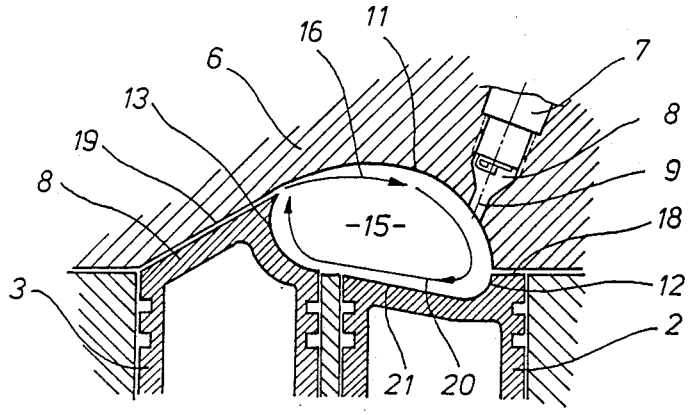
FIG. 1 is a cross-section through a first embodiment of a twin-piston two-stroke engine according to the invention, at top-dead-centre of the pistons.

The twin-piston two-stroke engine according to the first embodiment comprises a twin cylinder 1 in which the pistons 2, 3 run, being separated by a partition 24 in the cylinder block, according to FIG. 1.

Fuel-air mixture is forced into the left-hand cylinder 1*b* during the charging operation from the crankcase, through the induction port 4. This mixture pushes the burnt-out gases of the preceding working cycle in front of itself to the exhaust port 5 which is controlled by the right-hand piston 2. By means of the known control system of the Puch engine, the exhaust port 5 is uncovered earlier than the induction port 4.

During the upward stroke of the pistons 2, 3, the exhaust port 5 is closed earlier than the induction port 4, thereby preventing losses of unburnt gases, as is the case in a conventional two-stroke engine, where it leads to a higher consumption.

The spark plug 7 is situated in the cylinder head 6. In the embodiment of FIG. 1, it is situated in a precombustion chamber 8 having an outflow passage 9, the longitudinal axis of the outflow passage 9 pointing in the direction of the fuel-air mixture circulation 20 generated in the combustion chamber 15.

The circulation illustrated in FIG. 1 results from the following structural features:

The left-hand piston 3 has an oblique piston crown which is directed upwards obliquely in the form of a straight section 25, the straight section 25 extending parallel to and at a small distance from the associated straight surface of the cylinder head 6 at T.D.C. position, thereby forming a squish gap 19.

The straight section 25 on the piston crown of the cylinder 3 términates in a comb-like top piston edge 10 extending in horizontal direction, which is followed by a concave flute or the like 26 in the piston crown of the piston 3.

The piston 2 controlling the exhaust port 5 likewise has a recess in the piston crown next to the partition 24, the base of which is formed as a straight section 21. This straight section 21 is directed obliquely downwards and evenly continues the outline of the concave flute or the like 26 of the left-hand piston 3.

A concave flute 28 is machined into the piston 2 in the base of the recess 27, forming a piston curvature 12 which merges into a straight section 29. This straight section 29 forms a shorter second squish gap 18 in combination with the corresponding cylinder head surface.

Whilst the pistons 2 and 3 approach top-dead-centre, a squish gap 19 is formed between the top piston edge 10 and the cylinder head 6, from which the gas mixture flows out under very high pressure in the direction 16, causing a rotational flow in the combustion chamber 15. The rotation is generated by the shape of the cylinder curvature 11, of the piston curvature 12 and of the deflecting curvature 13. Its flow is enhanced furthermore by gases emerging from the squish gap 18. An additional impulse in the direction of flow is imparted by the ignited gas flowing out of the spark plug chamber 8 via the outflow passage 9.

Figure 3:
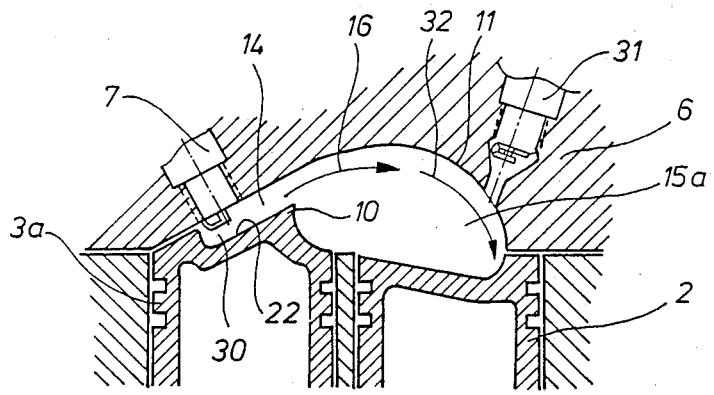
FIG. 3 is a second embodiment of a twin-piston engine according to the invention.

The embodiment according to FIG. 3 differs from that according to FIGS. 1 and 3, merely in that a recess 30 situated in the left-hand piston 3 has its base formed as a straight section 22, which is again approximately parallel to the upper rectilinearly formed surface of the cylinder head 6. A precombustion space 14 is formed thereby for a spark plug 7 situated in the cylinder head 6.

At the time of ignition, the mixture in the precombustion chamber 14 is ignited first and flows at high pressure and speed in the direction 16 into the main combustion space 15*a* causing a circulation of the gas in this space.

This circulation is assisted by the firing of a second spark plug 31. The firing of this second spark plug 31 occurs later than that of the first spark plug 7, that is to say not until the mixture ignited by the first spark plug approaches the area of the second spark plug 31.

Means of producing a stratified charge will now be described in relation to the embodiments of FIGS. 1 to 3.

An injection nozzle 33 is installed in the passage of the induction port 4 so as to squirt fuel into the passage at a particular instant. The injection period is such that the fuel is injected into the air stream only in the second portion of the total air volume, that is to say when a proportion of the inflowing air has already traversed the induction port 4. Preferably, the fuel is injected into the passage of the induction port 4 only when the proportion of the air which had traversed the induction port 4 already amounts to between a quarter and a half of the total air volume. As a result, the initial portion of the air is free of fuel and pushes the combustion gases before it towards the exhaust port 5 and conveys them out of this exhaust port 5, so that none of the fuel reaches the exhaust during the scavenging operation.

A stratified charge in a conventional two-stroke engine has been proposed (DE-OS No. 36 19 794), but is difficult to achieve in known two-stroke engines, since there is a direct communication through the undivided cylinder between the induction and exhaust ports. This is prevented in engines according to the invention by the partition 24 situated between the induction port 4 and the exhaust port 5. The air flow initially rises upwards in the left-hand cylinder 1*b*, moving over the partition 24 and downwards into the right-hand cylinder 1*a*, and so, at the end of scavenging, air free of fuel is consequently substantially present in the cylinder 1*a*, and air provided with fuel is present in the cyliner 1*b*.

During the compression stroke (upward displacement of the pistons 2 and 3 or 3*a*), the richer mixture is present in the area of the closure region 19 or the recess 30. It is ignited at this point by the spark plug 7 and flows in the direction 16 and 32 into the other fuel-free or lean portion of the combustion air, causing circulation of the ignited mixture in the direction 16 and 20.

Satisfactory intermixing and total combustion action occurs of the whole mixture, which may be very lean overall, since ignition occurs in the richer mixture in the area of the recess 30. It is possible to drive on even leaner mixtures with this stratified charge than is possible in the case of lean-mixture engines without a stratified charge, and the proportions of nitrous oxides are further reduced.

The second spark plug 31 may be omitted in the embodiment incorporating a stratified charge as described above.

It was stated in the preceding description, as a preferred embodiment, that the right-hand piston 2 has the particular crown shape described is associated with the exhaust port 5 whereas the left-hand piston 3 with its crown shaping constructed differently is associated with the induction port 4.

Figure 2:
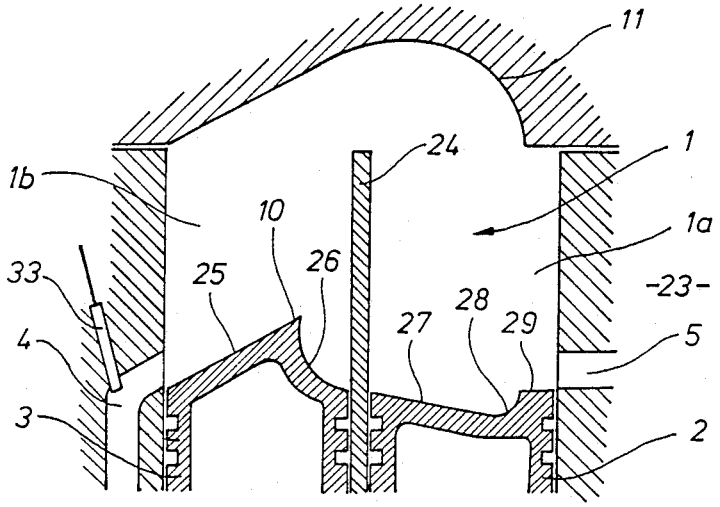
FIG. 2 is a cross-section through the same motor at bottom-dead-centre of the pistons.

The converse may also be true in a further embodiment of the present invention, namely that the pistons 2 and 3 may be interchanged whilst retaining the induction port 4 and the exhaust port 5 according to FIG. 2.

What is claimed is:

1. A twin-piston two-stroke engine comprising:

a cylinder block, a first cylinder formed in said cylinder block and provided with an induction port for a combustion mixture, a second cylinder formed in said cylinder block and provided with an exhaust port for burnt gases, a partition separating said first and second cylinders, first and second pistons reciprocally movable in said first and second cylinders respectively, a cylinder head covering said first and second cylinders to define a combustion chamber between the cylinder head and respective upper surfaces of said pistons at top dead center, wherein a squish gap is formed between an upper surface portion of said first piston and a corresponding opposed surface of the cylinder head to force the combustion mixture into the combustion chamber, the part of the cylinder head defining the combustion chamber being of substantially arcuate shape, the second piston having in its upper surface a curvature which from one end constitutes an extension of the arcuate surface of the cylinder head and terminates at its other end in a straight section and means for igniting said combustion mixture in said combustion chamber, wherein said cylinder head and said upper ends of said pistons are so shaped as to impart a swirling motion to said combustion mixture.

2. A two-stroke engine as claimed in claim 1, wherein a deflecting curvature is provided in the upper surface of said first piston to assist said swirling motion.

3. A two-stroke engine as claimed in claim 1 wherein said means for igniting the combustion mixture comprises a spark plug situated within a chamber in the cylinder head provided with an outflow passage, said outflow passage pointing in the direction of the swirling flow within the combustion chamber.

4. A two-stroke engine as claimed in claim 1, wherein a recess is formed in the upper surface of the first piston which at the top-dead-center position of the piston forms, together with a corresponding surface of the cylinder head, a precombustion chamber with the cylinder head, an ignition jet from which engenders the swirling flow in the combustion chamber.

5. A two-stroke engine as claimed in claim 4, wherein said means for igniting the combustion mixture includes a spark plug situated in the region of the precombustion chamber.

6. A two-stroke engine as claimed in claim 5, wherein a second spark plug is situated in the cylinder head in the circulatory flow region.

7. A two-stroke engine as claimed in claim 6, wherein the second spark plug is arranged to fire later than the first spark plug.

8. A two-stroke engine as claimed in claim 1, including fuel injection means whereby fuel is injected into the induction port.

9. A two-stroke engine as claimed in claim 8, in which the fuel is injected when part of the inflowing air has passed through the induction port.

10. A two-stroke engine as claimed in claim 9, in which the fuel is injected when the proportion of air having passed through the induction port lies in the range of one quarter to one half.

11. A two-stroke engine, comprising:

a cylinder block, a first cylinder formed in said cylinder block and provided with an induction port for a combustion mixture, a second cylinder formed in said cylinder block and provided with an exhaust port for burnt gases, a partition separating said first and second cylinders, first and second pistons reciprocally movable in said first and second cylinders respectively, a cylinder head covering said first and second cylinders to define a combustion chamber between the cylinder head and respective upper surfaces of said pistons at top dead center and means for igniting said combustion mixture in said combustion chamber, wherein said cylinder head and said upper ends of said pistons are so shaped as to impart a swirling motion to said combustion mixture and a recess is formed in the upper surface of the first piston which at the top-dead-center position of the piston forms, together with a corresponding surface of the cylinder head, a precombustion chamber with the cylinder head, an ignition jet from which engenders the swirling flow in the combustion chamber.

12. A two-stroke engine as claimed in claim 11, wherein said means for igniting the combustion mixture includes a spark plug situated in the region of the precombustion chamber.

13. A two-stroke engine as claimed in claim 12, wherein a second spark plug is situated in the cylinder head in the circulatory flow region.

14. A two-stroke engine as claimed in claim 13, wherein the second spark plug is arranged to fire later than the first spark plug.

15. A two-stroke engine as claimed in claim 11, including fuel injection means whereby fuel is injected into the induction port.

16. A two-stroke engine as claimed in claim 15, in which the fuel is injected when part of the inflowing air has passed through the induction port.

17. A two-stroke engine as claimed in claim 16, in which the fuel is injected when the proportion of air having passed through the induction port lies in the range of one quarter to one half.

18. A two-stroke engine as claimed in claim 11, wherein a squish gap is formed between an upper surface portion of said first piston and a corresponding opposed surface of the cylinder head to force the combustion mixture into the combustion chamber, the part of the cylinder head defining the combustion chamber being of substantially arcuate shape.

19. A two-stroke engine as claimed in claim 18, wherein the arcuate surface of the cylinder head together with the upper surfaces to the first and second pistons together impart a substantially oval flow pattern to the swirling combustion mixture.

20. A two-stroke engine as claimed in claim 11, in which said second piston has a flat region at its top and said cylinder head has a corresponding flat region, said flat regions cooperating to form a squish gap from which combustion gas is expelled into the combustion chamber as the pistons approach top dead center.

* * * * *